US009427371B1

(12) United States Patent
Lamar

(10) Patent No.: US 9,427,371 B1
(45) Date of Patent: Aug. 30, 2016

(54) RECLINING TRACTION CHAIR

(76) Inventor: Izzie Lamar, Sacramento, CA (US)

( * ) Notice: Subject to any disclaimer, the term of this patent is extended or adjusted under 35 U.S.C. 154(b) by 325 days.

(21) Appl. No.: 13/161,264

(22) Filed: Jun. 15, 2011

(51) Int. Cl.
*A61H 1/02* (2006.01)

(52) U.S. Cl.
CPC ..... *A61H 1/0218* (2013.01)

(58) Field of Classification Search
USPC ..... 602/32–36, 38–40; 482/10, 62, 69; 128/845–847; 5/621–624, 635, 647; 606/241–242, 237
See application file for complete search history.

(56) References Cited

U.S. PATENT DOCUMENTS 2,714,922 A * 8/1955 McKibban et al. ..... 297/83
4,144,880 A 3/1979 Daniels
4,688,557 A * 8/1987 Bradstreet ..... 606/241
5,330,254 A 7/1994 Larson
5,437,609 A * 8/1995 Leonard et al. ..... 601/91
5,931,535 A * 8/1999 Sweet ..... 297/354.13
5,957,528 A * 9/1999 Campbell ..... 297/228.12
6,203,107 B1 3/2001 Jonsson
6,439,636 B1 * 8/2002 Kuo ..... 296/65.09
6,626,494 B2 9/2003 Yoo
2001/0035668 A1 * 11/2001 Gaffney et al. ..... 297/85

* cited by examiner

*Primary Examiner* — Ophelia A Hawthorne

(57) ABSTRACT

A traction chair is disclosed which functions as a normal chair when not in use, but which can be deployed to provide a user with traction for decompressing the spine. The traction chair employs a stationary framework that is supported on the ground. A number of articulating components are mounted on the stationary framework; the articulating components being actuated by a motive force. The articulating components when actuated together cause the seat portion of the chair to separate from the backrest portion and open up a widening gap between the seat portion and backrest portion of the chair.

10 Claims, 13 Drawing Sheets

RECLINING TRACTION CHAIR

BACKGROUND

1. Related Applications

Not Applicable

2. Technical Field

This invention relates to devices which provide a traction force to the human body and more particularly to a reclining traction chair.

Some of the main causes of compression to the human spine include everyday gravitational forces upon the human body, poor posture and poor muscle-skeletal alignment. Spinal compression can manifest itself as minor back pain, but can also progress to nerve damage in more serious cases. Therefore, it has been found to be beneficial to decompress the spine. Decompression allows the spine to relax and realign properly and also to relax and rehydrate the spinal discs located between vertebrae.

A number of methods of decompression involve devices which provide traction to the spine. Traction is the deliberate and prolonged pulling of a muscle or body part to correct dislocation, cause realignment and relieve pressure. Classic traction appliances include the various inversion-type devices which involve inverting the body so that the feet are held fast and the remainder of the body is decompressed through gravity. These devices included inversion boots or inversion tables. A major problem with inversion is that it causes blood to rush toward the head and pool in the upper extremities. People who have heart disease, high blood pressure, eye diseases (such as glaucoma), or are pregnant are at higher risk for complications from inversion therapy and should consult their doctors first to be informed of the risks or else avoid inversion therapy altogether.

Other traction devices for relieving pressure on the spine have come in the form of appliances which immobilize the neck and then apply traction force to the body. U.S. Pat. No. 6,626,494 (Yoo) discloses a traction chair which has a fixture for holding the neck and head immovable while the rest of the body is gradually lowered when the chair is lowered, and a type of gravity traction is applied.

U.S. Pat. No. 4,144,880 (Daniels) discloses a traction table. FIG. 3 of this patent shows a patient with his head and feet immobilized in a harness while the patient's lumbar area is suspended in a gap located between upper and lower table platforms.

U.S. Pat. No. 5,330,254 (Larson) discloses a workplace chair which has a separation gap between the chair back and chair seat upon which a seated worker can suspend the lumbar area of the spine through gravity (See FIG. 7). However, this chair has no method of preventing the upper body from dropping further into the gap from gravity; thus presumably the user would have to constantly readjust as the lumber region becomes uncomfortably jammed into the gap. This patent also suggests further impractical seating positions for a worker (See FIG. 8).

U.S. Pat. No. 6,203,107 (Jonsson) discloses a chair having a separated chair back and chair seat which creates a gap (See FIGS. 8 and 9). This chair has a weight bearing platform on the back portion of the seat, which flexes downward when a person sits in this chair, thus allowing the lumbar area to suspend and decompress, while at the same time providing some support to the seated person's lower body.

The previously mentioned art for relaxing the human spine ranges from medical traction tables to exercise apparatus to office furniture that is of questionable utility. A need exists for a practical and comfortable home traction chair which is attractive in appearance and which provides traction to the spine while a person is relaxing during normal home activities such as watching TV or reading.

The foregoing reflects the state of the art of which the inventor is aware, and is tendered with a view toward discharging the inventor's acknowledged duty of candor, which may be pertinent to the patentability of the present invention. It is respectfully stipulated, however, that the foregoing discussion does not teach or render obvious, singly or when considered in combination, the inventor's claimed invention.

SUMMARY OF THE INVENTION

The invention is a traction chair that is easily integrated as a piece of household furniture, and that provides traction relief to a person seated therein. The traction chair is comprised of a seat back and a seat portion, wherein the seat back and seat portion can be articulated so as to open up a gap between them. The user seats himself in the chair and then articulates the chair so that the gap opens beneath the vertical line of the user's spine, causing the weight of the lower body to suspend slightly into the gap, thus creating traction by gravity. In the preferred embodiment, the traction chair has a frictional material located on the top surface of the seat and on the front surface of the back rest. The frictional material grips the clothing or skin of the seated user and allows for mechanical traction to be applied to the user's body; essentially allowing the lower body to be pulled away from the upper body, thus increasing the tractive force upon the spine beyond that applied by gravitational traction alone.

The inventive traction chair is also functional as a piece of household furniture that provides a level of comfort and practicality for every-day use. The traction chair can be used during relaxation activities such as TV watching and reading, thus allowing a user to obtain the benefits of traction without having to use inversion techniques or traction tables. The traction chair can be used as a recliner, for example, but if traction is desired, then the user can engage the articulation of the seat and backrest so as to apply tractive force to the seated user.

Accordingly, the following objects and advantages of the invention apply:

It is an object of this invention to provide a traction chair that is a comfortable and practical every day option when compared to other traction appliances.

It is another object of this invention to provide a traction chair which can also be used as an attractive piece of household furniture.

Further objects and advantages of the invention will be brought out in the following portions of the specification, wherein the detailed description is for the purpose of fully disclosing the preferred embodiments of the invention, without placing limitations thereon.

BRIEF DESCRIPTION OF THE DRAWINGS

The invention will be more fully understood by reference to the following drawings which are for illustrative purposes only.

DETAILED DESCRIPTION OF THE PREFERRED EMBODIMENTS

Figure 1:
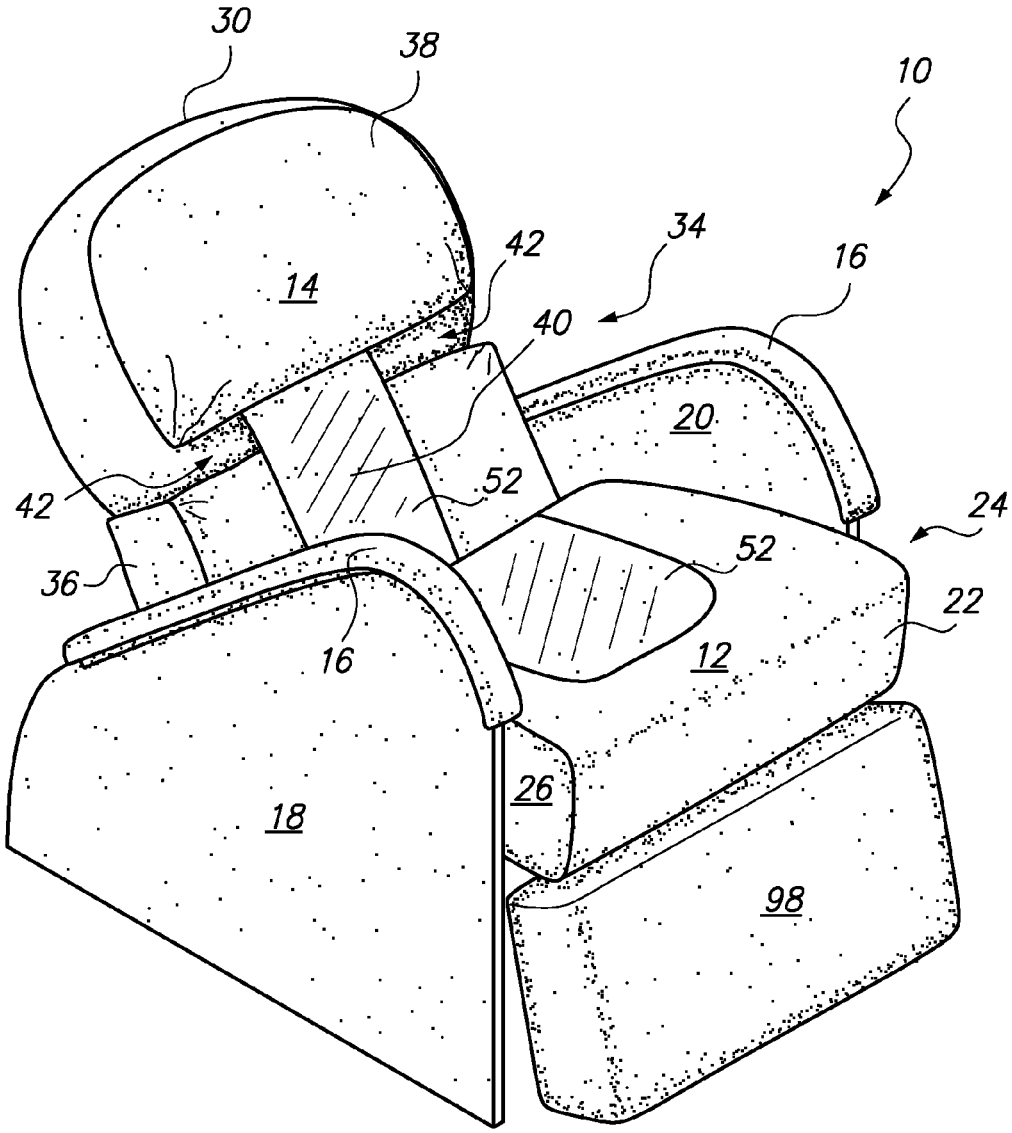
FIG. 1 is a perspective view of the inventive traction chair.
Figure 2:
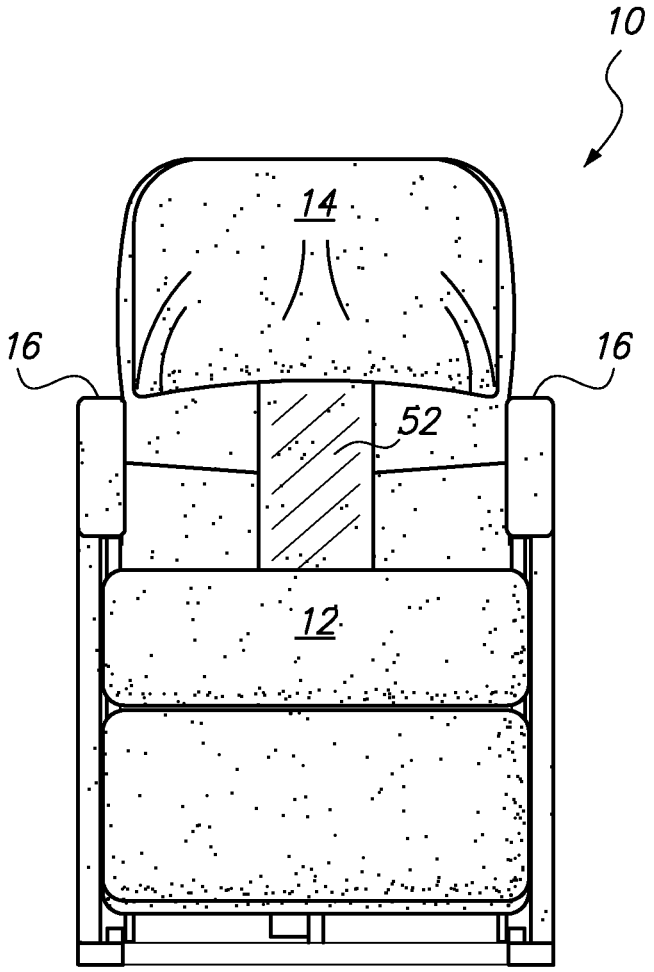
FIG. 2 is a front view of the inventive traction chair.
Figure 3A:
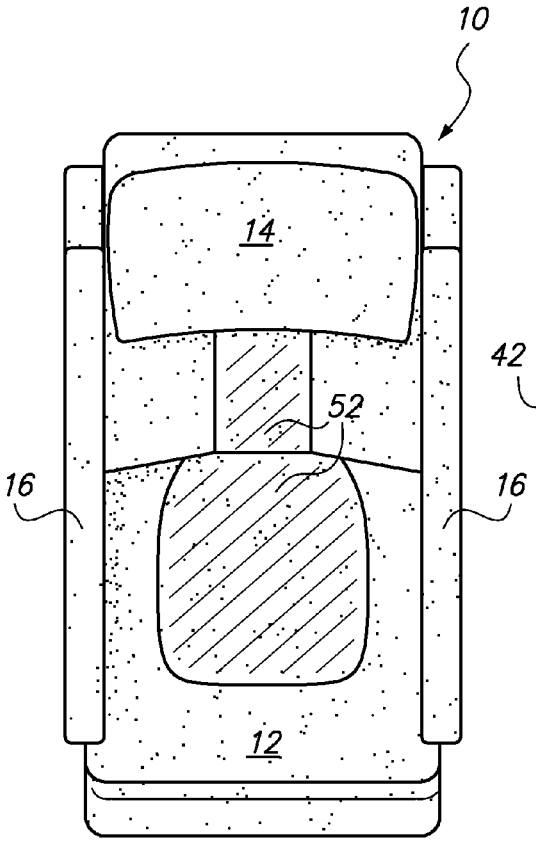
FIG. 3A is a plan view of the inventive traction chair in its non-deployed state.
Figure 3B:
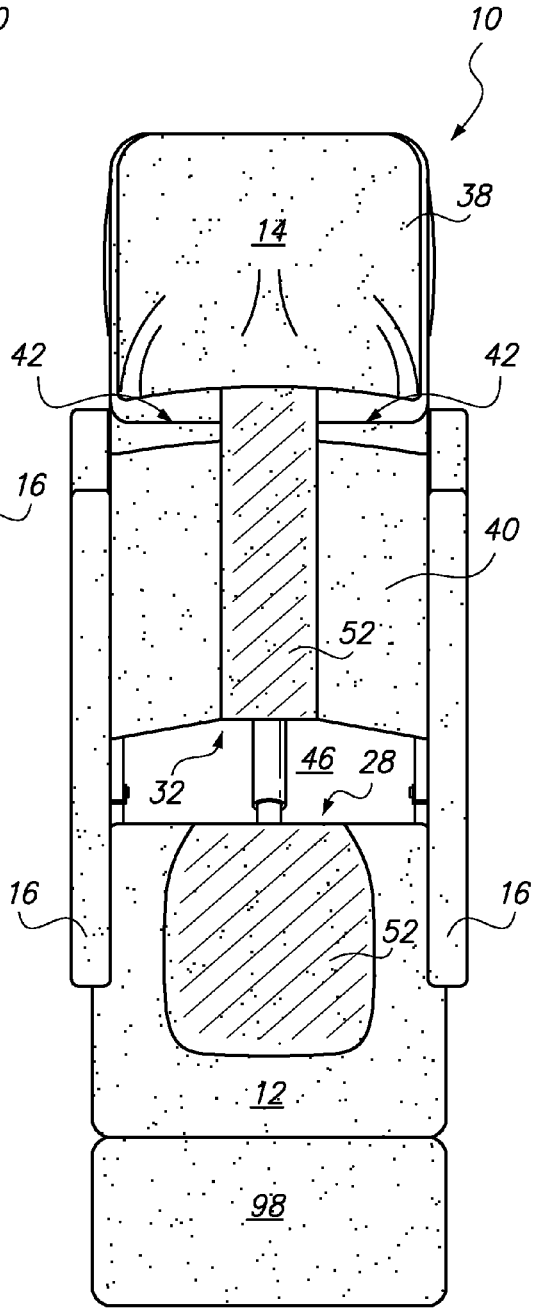
FIG. 3B is a plan view of the inventive traction chair in its deployed state, showing the gap located between the seat and backrest.

The inventive reclining traction chair 10 is shown in FIGS. 1-3A, 3B which has the appearance of a typical "recliner" and could be used as such. The chair 10 has a padded seat 12, a padded backrest 14, padded armrests 16 located on either side 18, 20 of the padded seat and a padded footrest 98. The padded seat 12 has a front side 22, left and right sides 24, 26 and a rear side 28. The padded backrest 14 includes a top 30, bottom 32 and left and right sides 34, 36, a head pad 38 and a back pad 40; near the sides 34, 36 of the backrest 14. Between the head pad 38 and back pad 40 are gaps 42 to allow the shoulders space to fall into during traction. By relieving pressure on the shoulders, the chest of a user opens up and relaxes during traction.

Figure 4:
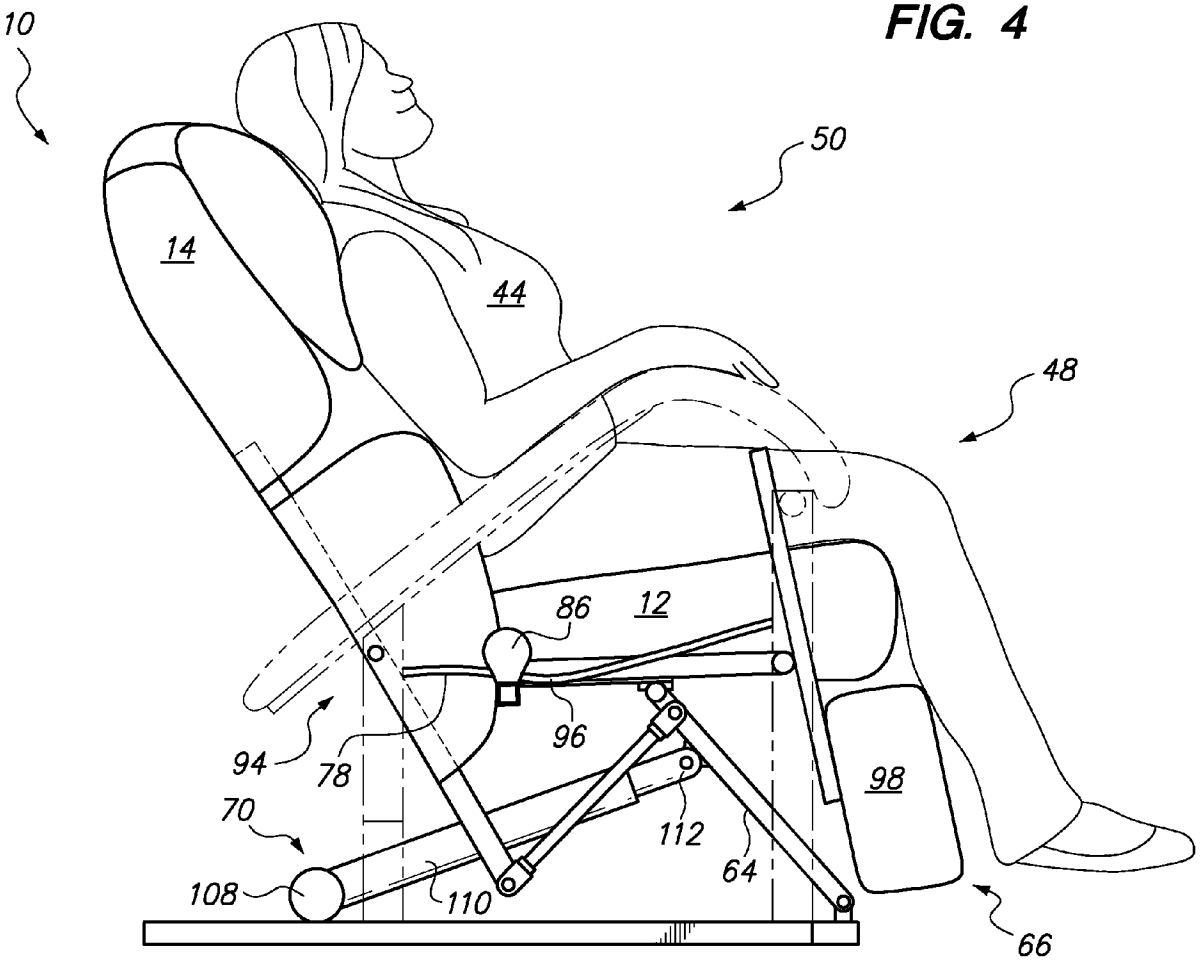
FIG. 4 is a side view of the inventive chair with an armrest shown in phantom so that the user's body position can be viewed; this view shows the user's body position with the chair at rest prior to actuating its tractive capabilities.
Figure 5:
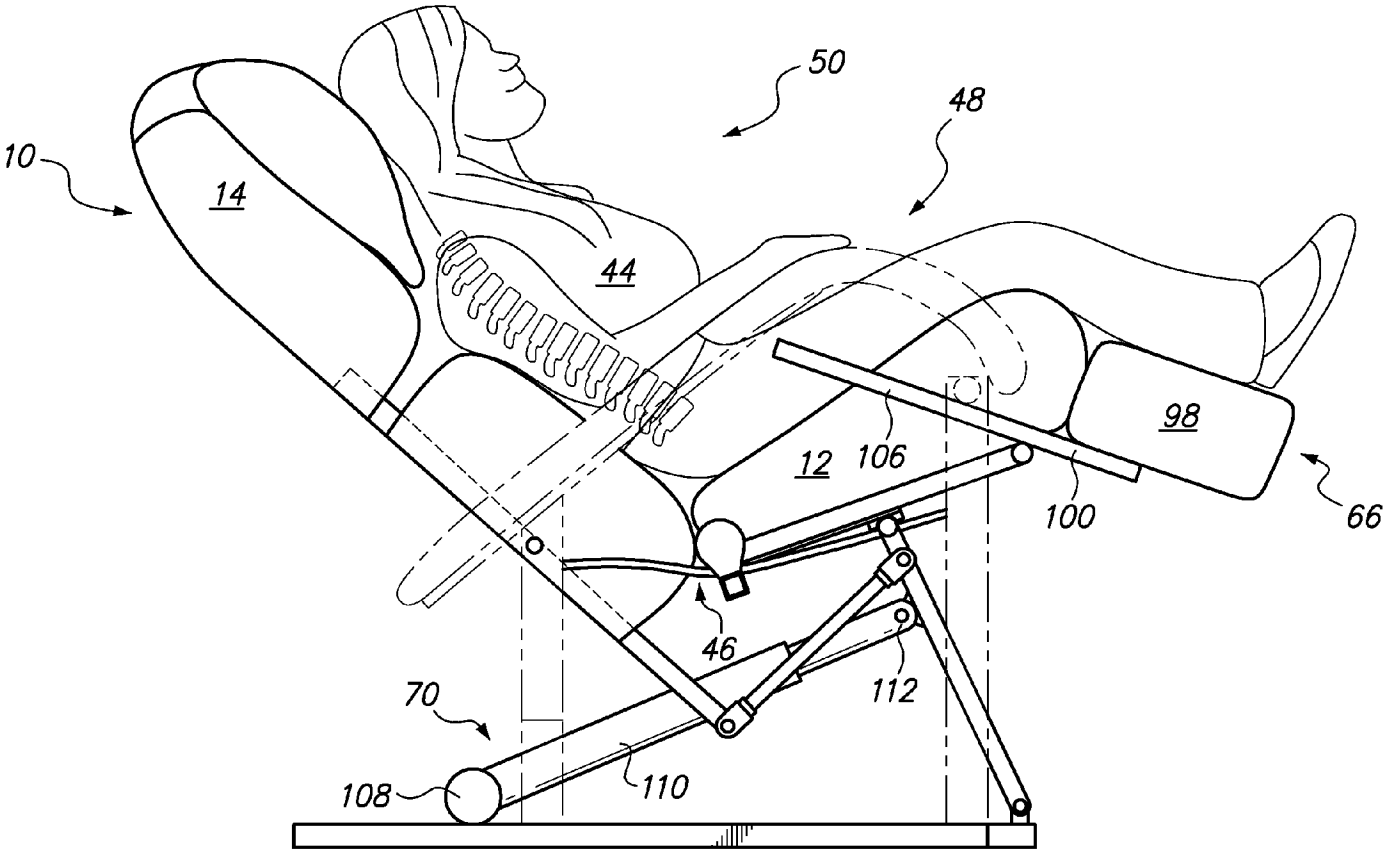
FIG. 5 is a side view of the inventive chair with an armrest shown in phantom so that the user's body position can be viewed; this view shows the user's body position cradled within the backrest and seat upon actuating the chair's tractive capabilities.
Figure 6:
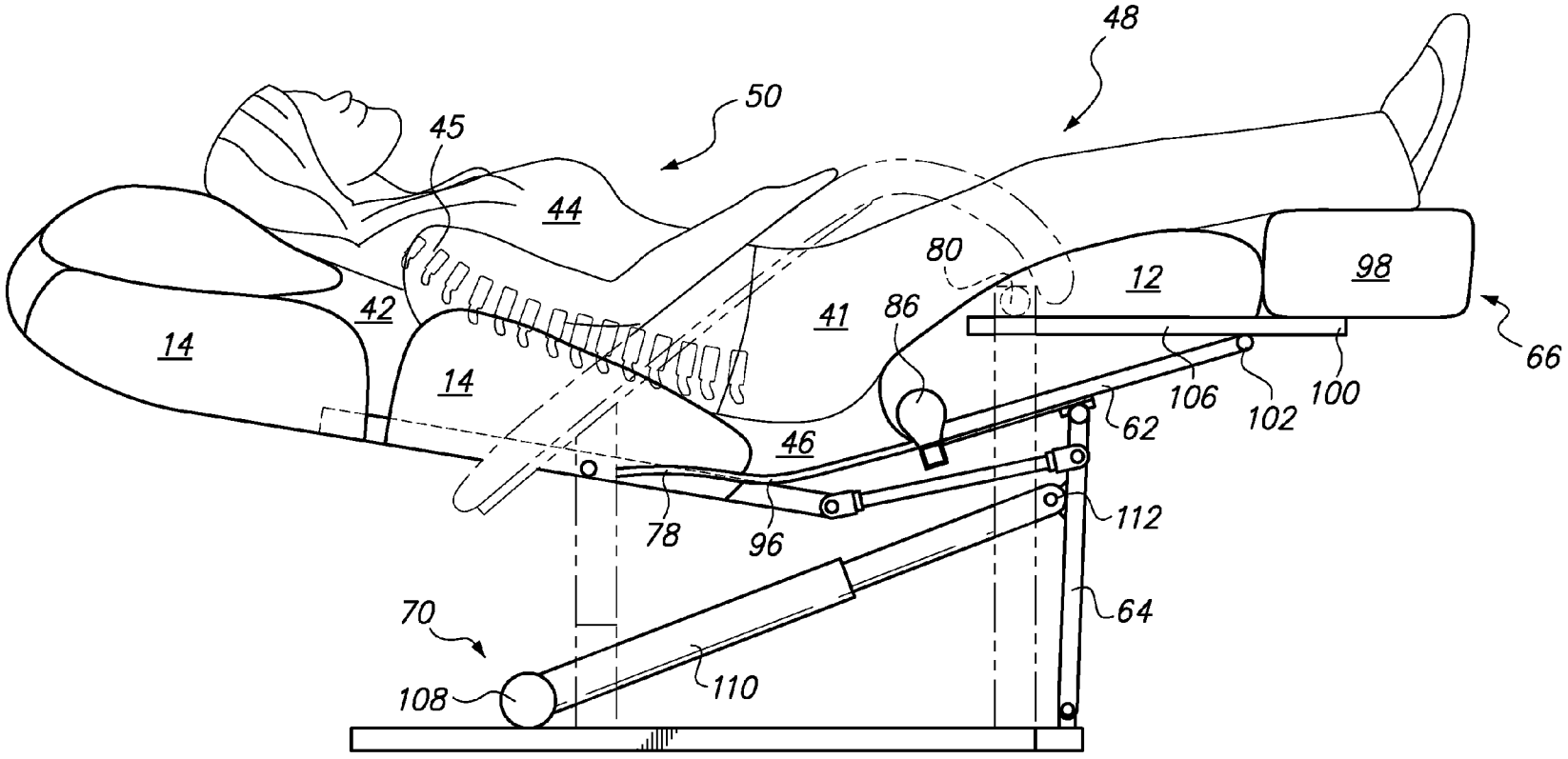
FIG. 6 is a side view of the inventive chair as shown in FIG. 5, with the backrest and seat separated at their maximum deployment.

FIG. 4 shows a side view of the chair 10 with a user 44 seated therein and using the chair 10 in normal fashion. In FIG. 5, the user 44 has decided to actuate the traction capabilities of the chair 10 and as shown, the backrest 14 and seat 12 begin to separate to form a gap 46, while at the same time the backrest 14 tilts backward and the seat 12 travels forward and tilts upward as shown. In FIG. 6, the backrest 14 and seat 12 have reached their maximum range of travel and the user's buttocks 41 are located in the gap 46. In FIGS. 5 and 6, the user 44 is cradled in a tilted orientation in the chair, so that the user's weight is born in the chair cradle. When the gap 46 is widened, the user's sacral region and hips sink partially into the gap. This creates a gravitational traction on the spine which helps the spine's initial relaxation to occur. Also, relaxation of the shoulders 45 is aided by gaps 42 in backrest 14 which allow the shoulders 45 to fall by gravity, especially in the orientation shown in FIG. 6. When shoulders 45 fall into gaps 42, the chest opens up and causes further relaxation.

As the gap 46 is opened wider, the mechanical tractive force of the chair 10 further causes the lower body 48 (located in the seat) to be pulled in a direction opposite from the upper body 50 (located against the backrest). Separation is aided by a frictional material 52 covering the body-facing surfaces of both the seat 12 and the backrest 14. This frictional material 52 grips a user's clothing as the gap 46 is widened, thus maintaining the user's lower body 48 in the seat as immobile as possible and further maintaining the user's upper body 50 as immobile as possible against the backrest 14. The frictional material 52 operates on a similar principal as neck harnesses, cables, or head retaining appliances often seen used with traction tables; that is, to maintain body parts as immobile as possible so that as traction is applied, the lower body 48 and upper body 50 are pulled in opposite directions, thus opening up the spine and relieving pressure thereon. The inventor has found that material used on motorcycle seats provides an exemplary frictional material which suffices for the purposes of the invention.

Figure 7:
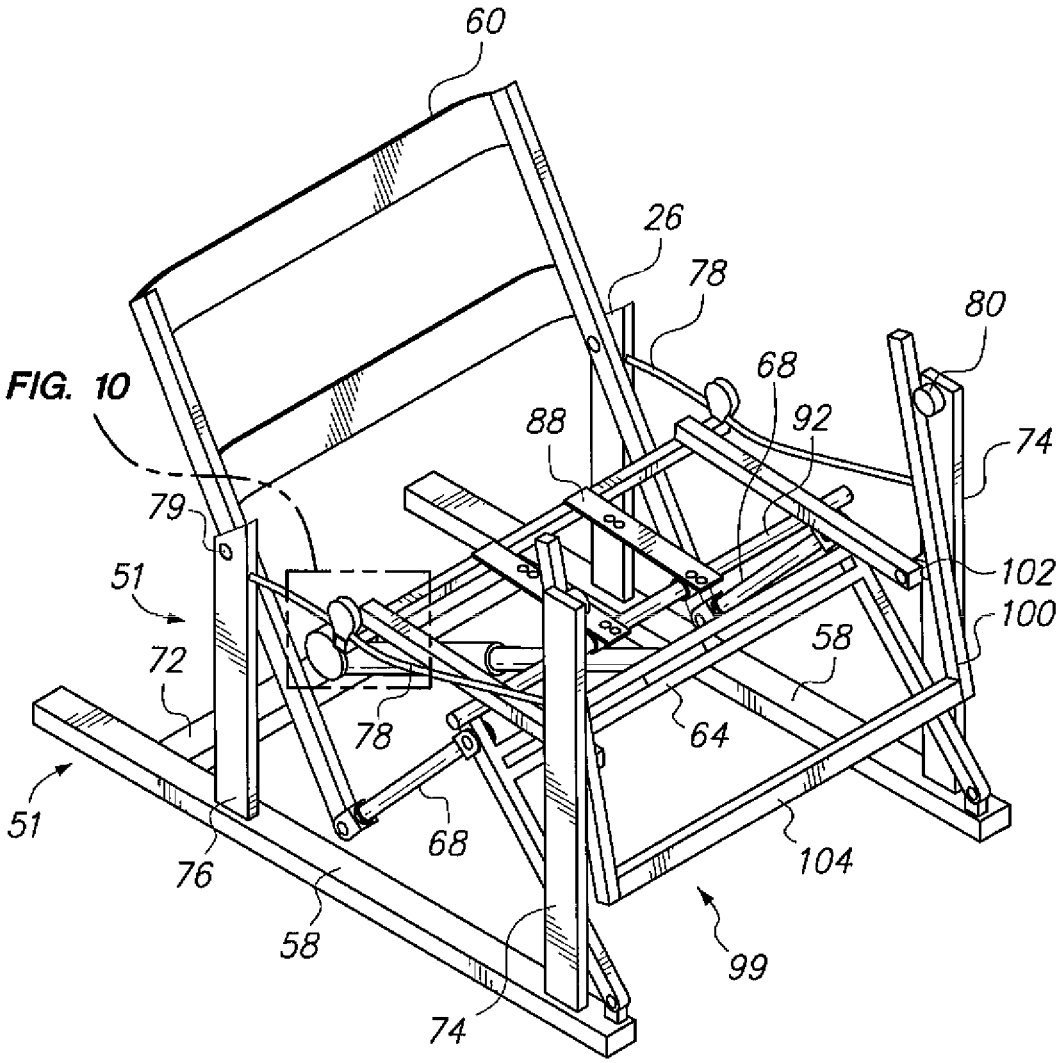
FIG. 7 is a front perspective view of the framework and articulating components of the inventive chair with the padded backrest and seat removed.

FIG. 7 shows the framework and articulating components of the inventive traction chair 10 which underlies the padded seat 12, backrest 14 and footrest 98. As shown, a central stationary framework 51 provides a foundation upon which are hung the articulating components of the chair 10. The articulating components are comprised of all the components which move upon actuating the chair 10. These include the backrest framework 60, the seat carriage 62, front seat carriage support 64, footrest assembly 66, connecting rods 68 and electronic telescoping actuator 70.

Figure 8A:
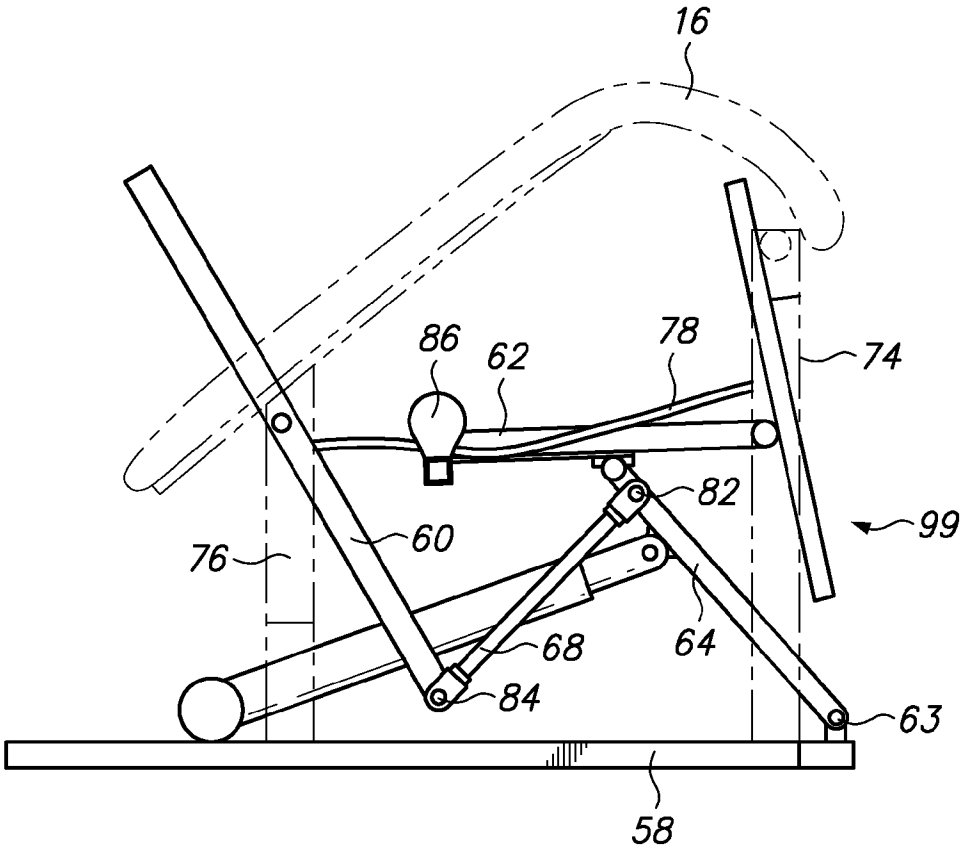
FIG. 8A is a side perspective view of the framework and articulating components of the inventive traction chair shown in a non-deployed state.

Framework 51 is comprised of a base which includes left and right side foot members 58 which are connected by cross beam 72 and four vertical members, two in front 74 and two in the rear 76. Cross beam 72 includes a mounting plate (not shown) for the electronic telescoping actuator 70 which will be discussed in more detail later herein. Referring also to FIG. 8A, left and right armrests 16 are connected to the central stationary framework by vertical members. Left and right guide rails 78 connect front and rear vertical members 74, 76 and guide rails 78 are mounted parallel with left and right armrests 16. At the uppermost points of left and right front vertical members 74 are mounted rollers 80 which face each other on the inside of vertical members 74.

Figure 8B:
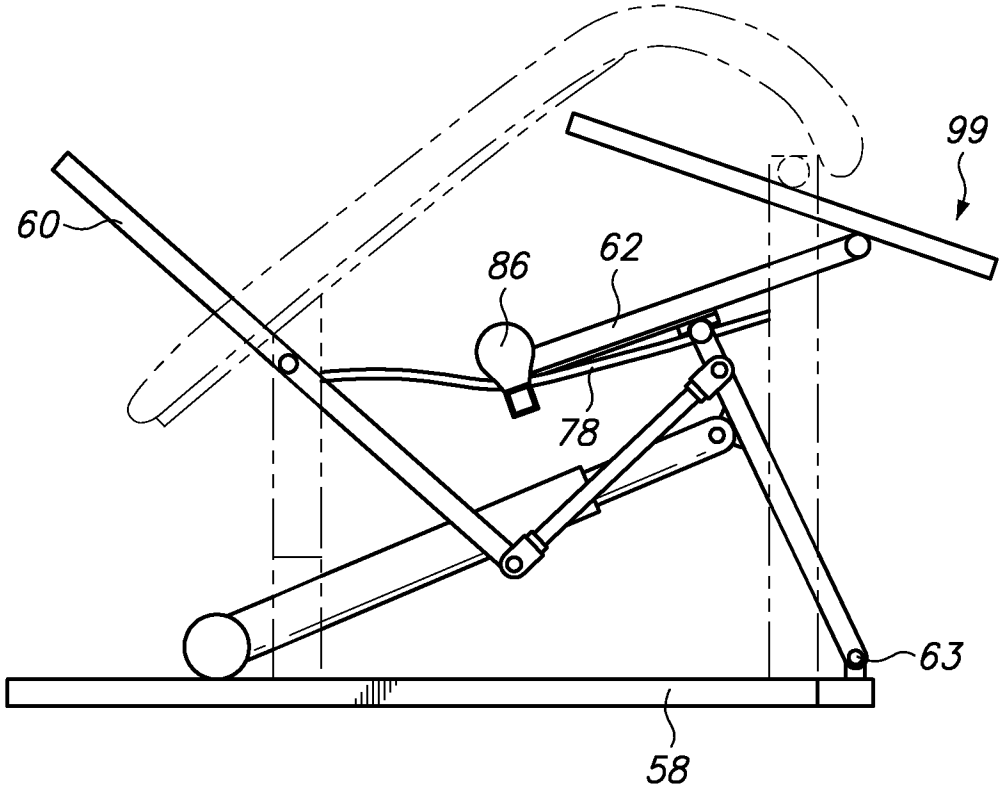
FIG. 8B is a side perspective view of the framework and articulating components of the inventive traction chair shown in a partially-deployed state.
Figure 8C:
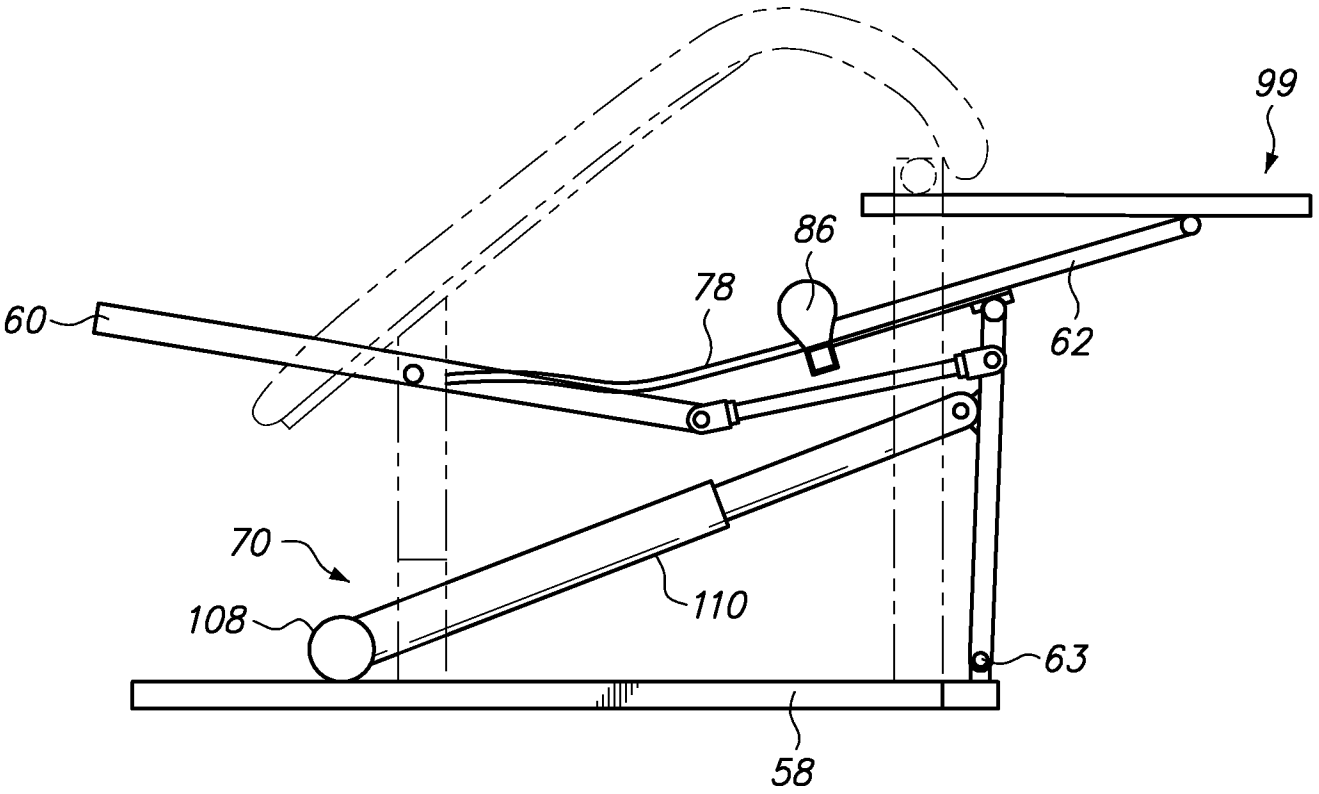
FIG. 8C is a side perspective view of the framework and articulating components of the inventive traction chair shown in a fully-deployed state.

FIGS. 8A-8C illustrate the graduated movement of the articulating components as the chair is articulated from a resting position (FIG. 8A), to a middle position (FIG. 8B), to a fully deployed position (FIG. 8C). The articulation is achieved by the movement of actuator 70 coupled with the connection of the articulating components which transfer the force from the actuator 70 throughout the various components. By illustration, the connecting rods 68 connect the backrest framework 60 to the seat carriage support 64 and in turn backrest framework is pivotally connected 79 to rear vertical members 76. Connecting rods 68 have a first end 82 which pivotally connects to the top of the seat carriage support 64 and a corresponding second end 84 which pivotally connects to a bottom end of the backrest framework 60. Connecting rods 68 provide a linkage connecting backrest framework 60, seat carriage support 64 and seat carriage 62, thus allowing them to articulate in a simultaneously coordinated fashion.

Figure 9:
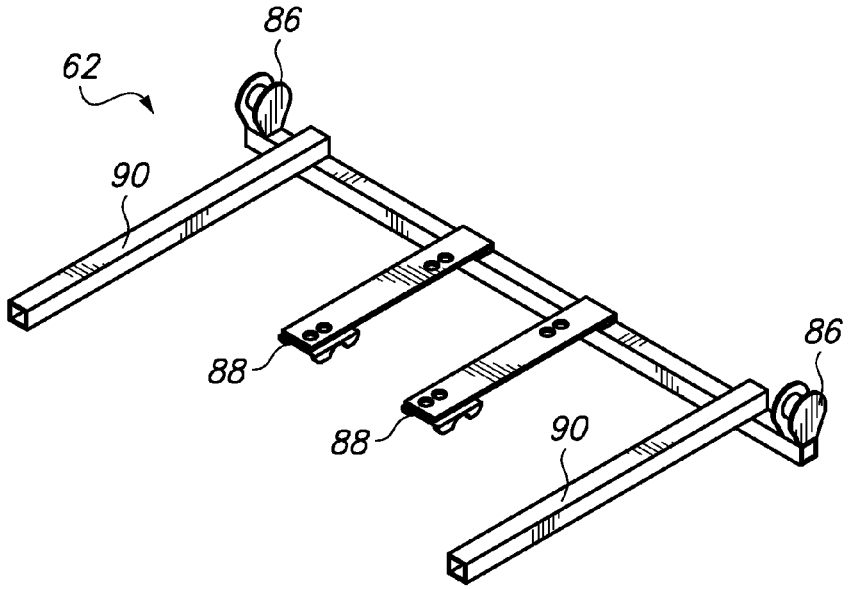
FIG. 9 is a perspective view of the seat carriage of the inventive traction chair.

Seat carriage 62 travels horizontally forward and back on left and right guide rails 78; when traveling in its forward horizontal direction, the seat carriage 62 separates seat 12 from the backrest 14, thus opening up the gap 46 between the seat and backrest as discussed above. As further shown in FIG. 9, seat carriage 62 is essentially a framework, laid horizontally, which supports the seat. A pair of rollers 86 is attached to seat carriage 62 in an outboard fashion, which allows them to engage with left and right guide rails 78, the rollers 86 being spaced to fit over guide rails 78 and travel evenly upon them. A seat carriage support mounting bracket 88 is located in the center of seat carriage 62. Mounting bracket 88 attaches to cross tube 92 of front seat carriage support 64. Left and right side rails 90 of seat carriage 62 extend substantially forward of mounting bracket 88.

Figure 10:
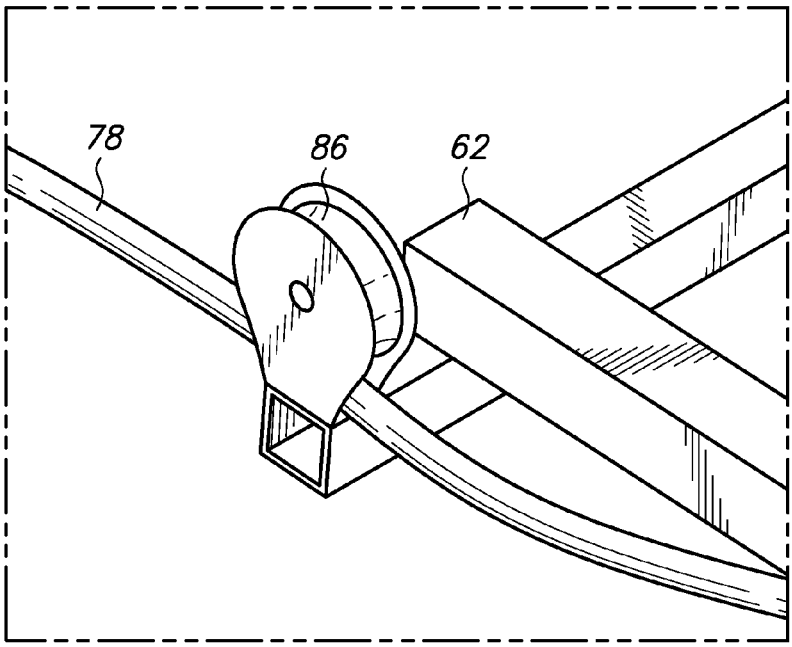
FIG. 10 is a close up elevated perspective view of the seat carriage attached to the carriage rails.

FIG. 10 shows the seat carriage 62 mated with the guide rails 78. When rollers 86 are mated to guide rails 78, they provide a weight-bearing support for the rear of the seat carriage 62. The seat carriage support 64 is pivotally connected 63 to foot members 58 which provides a more forward-positioned weight bearing support for the seat carriage 62 (See FIGS. 8A-8C).

As shown in FIGS. 8A-8C, as seat carriage 62 travels upon the left and right guide rails 78 the orientation of seat carriage shifts as the seat carriage travels along the contours imparted into left and right guide rails. Guide rails are contoured with an upward angle as they extend to the front of the chair 10. As the seat carriage travels forward, the upward slope of the guide rails 78 causes the seat 12 to angle upward. This action tends to lift the user's feet off of the ground causing the user 44 to be cradled by the seat 12 and backrest 14 as shown in FIG. 6. This suspension of the user's body off the ground causes the user's weight to sink into the gap 46. Toward the rear 94 of the chair 10, guide rails 78 adopt a severe concave bend 96 which, when the seat 12 travels backward, causes rollers 86 to dip into the bend 96, which causes the seat 12 to angle downward, to a level orientation (See FIG. 4). At this point the user is again sitting upright and his feet are flat on the ground as shown in FIG. 4 and the gap 46 between seat and backrest is nonexistent. The traction chair 10 can then be used as any normal chair in this orientation.

The inventive traction chair 10 has a footrest assembly 66 that is deployed when the chair is in its maximum traction orientation as shown in FIG. 6. The footrest assembly 66 is designed to actuate into a deployed position as the seat carriage moves to its forward positioning. Footrest assembly 66 is comprised of a frame 99 attached to a footrest cushion 98. Frame 99 has two rearward-extending side rails 100 joined by cross-member 104. Side rails 100 are pivotally attached to the front of seat carriage 62 at pivotal attachment points 102. A length of side rails 106 extend rearward of the attachment points 102. The rearward extension of side rails engages rollers 80 attached near the top of front vertical member 74. As seat carriage 62 travels forward it forces the rearward extensions 106 against rollers 80, causing the footrest assembly 66 to rise to a deployed position (See FIGS. 4-6); when the seat carriage 62 travels in reverse, the footrest assembly 66 falls until it reaches a stowed position.

The actuator 70 is preferably comprised of an electric motor 108 attached to a telescoping shaft 110. In FIGS. 4-6, the chair is shown with the telescoping shaft 110 traveling from minimal to maximum deployment. The electric motor 108 attaches to motor mount (not shown) on cross beam 72. The telescoping shaft 110 has a first end which connects at pivotal attachment point 112 to the front seat carriage support 64. The second end of the shaft 110 connects to the electric motor 108. The electric motor 108 can be selectively actuated in a forward and reverse direction. The forward direction places force on the front seat carriage support 64 and causes the seat 12 to travel forward in the manner previously described. The remaining articulating components also operate as described herein. When the forward-most extension of telescoping shaft 110 is reached (See FIG. 6), the widest gap 46 between seat 12 and backrest 14 is also achieved; however a user may actuate the motor to whatever point feels most comfortable and which decompresses the spine.

Manual methods of actuation are also contemplated in the invention. For example, although not shown in the drawings, a manual actuating handle could be used as a means for supplying motive force (in place of actuator 70) to the articulating components of the traction chair. The handle would be operated by the user's muscle force, and force could be applied by the user against the front seat carriage support 64 through a linkage attached to the handle. The handle could be engineered to have several "stops" so that the user could selectively actuate the chair to achieve different sizings of gap 46 which most comfortably fit the user and decompress the spine.

Figure 11:
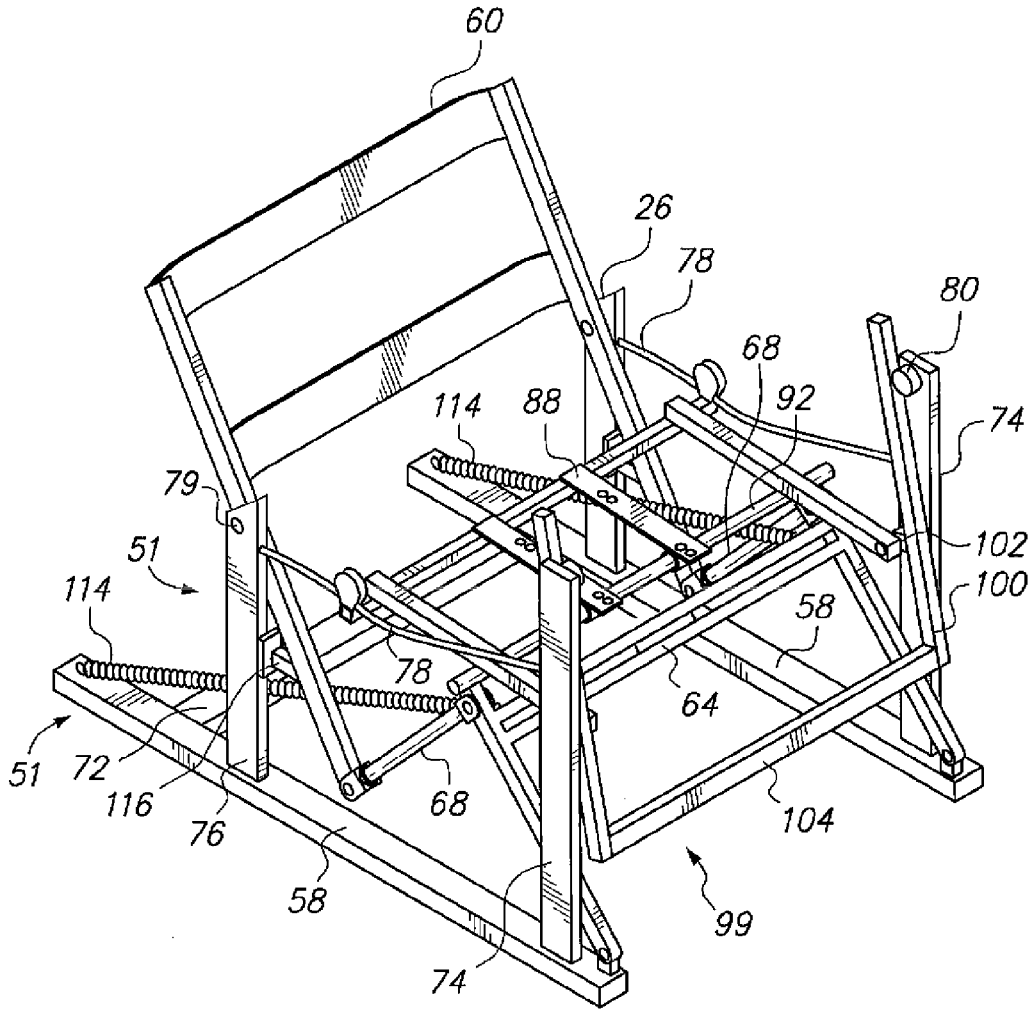
FIG. 11 is a perspective view of a manual embodiment of the inventive traction chair.
Figure 12:
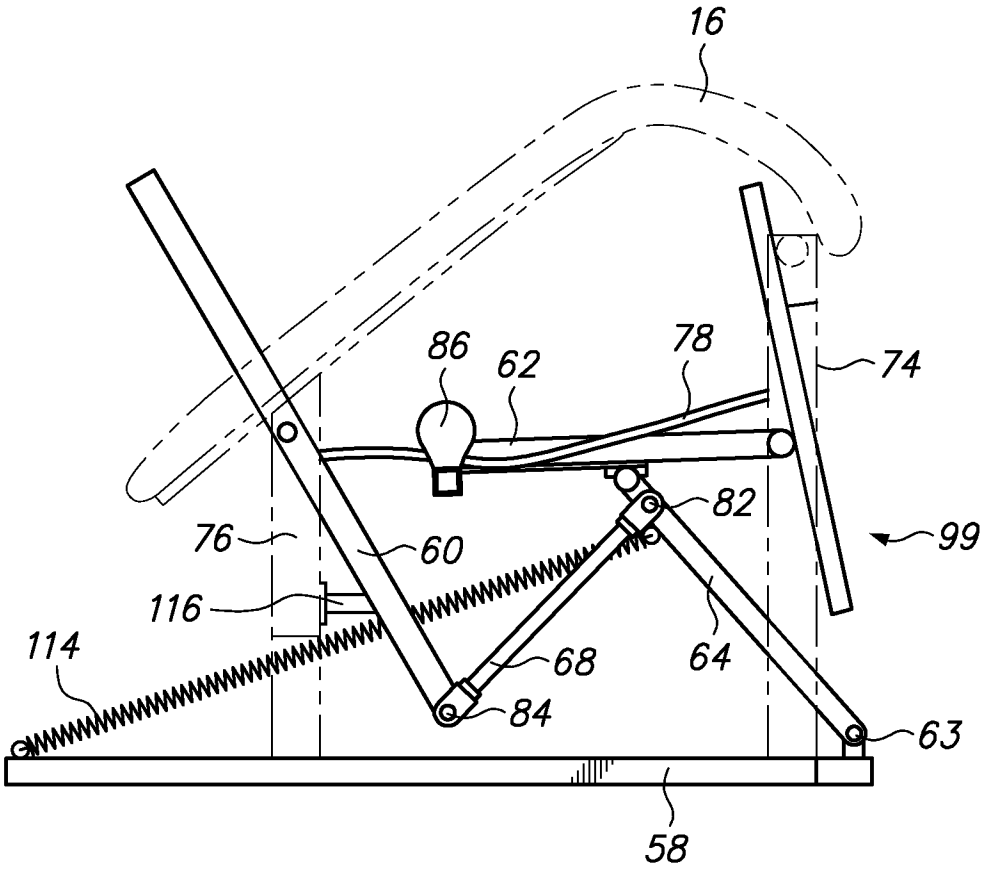
FIG. 12 is a side view of the manual embodiment of FIG. 11.

FIGS. 11 and 12 propose a second manual means for actuating the chair. In this embodiment, a pair of springs 114 are attached to foot members 58 at their first ends and further attached to seat carriage support 64 at their second ends. The user 44 would seat herself in the chair 10 and push down and forward on arm rests 16, and lean back against backrest 14, thus manually causing seat 12 to move forward on guide rails 78 and cause gap 46 to open up. At maximum extension of springs 114, the maximum gap 46 would be opened. A stop or lockout position could be engineered by means well known in the art when the maximum extension is reached, thereby allowing the user to relax from applying manual force upon armrests 16. When it is desired to retract the chair, the user 44 would grasp armrests 16 and apply downward force on footrest assembly, thereby overcoming the lockout position and forcing the seat 12 to travel rearward, thereby causing the chair 10 to return to its retracted position as shown in FIG. 1. Stop 116 would prevent any further rearward travel of backrest 14 once the chair 10 returns to its retracted position.

Finally, although the description above contains much specificity, this should not be construed as limiting the scope of the invention, but as merely providing illustrations of some of the presently preferred embodiments of this invention. This invention may be altered and rearranged in numerous ways by one skilled in the art without departing from the coverage of any patent claims, which are supported by this specification.

The invention claimed is:

1. A traction chair apparatus, comprising:

a backrest;

a seat, said seat having a front side and a rear side, wherein said rear side of said seat contacts said backrest when said seat is in a retracted position;

articulating components articulating said seat in a forwardly direction to achieve a separation of said rear side of said seat from said backrest to open up a gap between said rear side of said seat and said backrest;

said articulating components articulating said seat in a further forwardly direction causing widening of said gap between said rear side of said seat and said backrest and applying traction to a user seated in said traction chair apparatus;

said articulating components continuing to articulate said seat in a forwardly direction to achieve even further widening of said gap between said rear side of said seat and said backrest into a fully deployed position;

said seat articulating in a forwardly direction being oriented into an upwardly tilted attitude during travel in a forwardly direction.

2. The traction chair apparatus as recited in claim 1, further comprising an actuator, said actuator transferring force to said articulating components and articulating said articulating components to a fully deployed position.

3. The traction chair apparatus as recited in claim 2, wherein said actuator further comprises an electric motor attached to a telescoping shaft.

4. The traction chair apparatus as recited in claim 2, wherein said actuator is a manual actuator.

5. The traction chair apparatus as recited in claim 1, wherein one of said articulating components comprises a seat carriage, said seat carriage being attached to said seat, said seat carriage allowing the travel of said seat in a forwardly direction causing complete separation of said backrest from said rear side of said seat to open a gap between said backrest and said rear side of said seat.

6. The traction chair apparatus as recited in claim 5, further comprising left and right guide rails, said seat carriage further comprising left and right rollers, said rollers traveling upon said left and right guide rails.

7. A traction chair apparatus, comprising:

A backrest;

a seat, said seat having a front side and a rear side, wherein said rear side of said seat contacts said backrest at a first position;

means for articulating said seat in a forwardly direction, said means for articulating said seat in a forwardly direction causing complete separation of said backrest from said rear side of said seat to open a gap between said backrest and said rear side of said seat at a second position, said seat being disposed into an upwardly tilted attitude while articulating in a forwardly direction;

said gap being sufficient for allowing at least a sacral region of a user to descend into said gap.

8. The traction chair apparatus as recited in claim 7, further comprising a frictional material covering a body-facing surface of said backrest and said seat.

9. The traction chair apparatus as recited in claim 8, further comprising an electronic actuator, said electronic actuator causing articulation of said seat and backrest so as to open or close said gap between said backrest and seat.

10. The traction chair apparatus as recited in claim 7, wherein said backrest further comprises gaps for positioning a user's shoulders.

* * * * *